US006195987B1

(12) United States Patent
Miyashita

(10) Patent No.: US 6,195,987 B1
(45) Date of Patent: Mar. 6, 2001

(54) EXHAUST GAS PURIFYING APPARATUS OF INTERNAL COMBUSTION ENGINE

(75) Inventor: Shigeki Miyashita, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/390,874

(22) Filed: Sep. 7, 1999

(30) Foreign Application Priority Data

Nov. 25, 1998 (JP) ..... 10-334277

(51) Int. Cl.[7] ..... F01N 3/00
(52) U.S. Cl. ..... 60/285; 60/278
(58) Field of Search ..... 60/276, 278, 285, 60/286, 301

(56) References Cited

U.S. PATENT DOCUMENTS 5,201,173 * 4/1993 Fujimoto et al. ..... 60/278
5,448,887 * 9/1995 Takeshima ..... 60/285
5,482,020 * 1/1996 Shimizu et al. ..... 60/278
5,595,060 * 1/1997 Togai et al. ..... 60/285
5,894,725 * 4/1999 Cullen et al. ..... 60/285

FOREIGN PATENT DOCUMENTS 7305644 11/1995 (JP) .
7310534 11/1995 (JP) .
1047121 2/1998 (JP) .
5825806 12/1993 (WO) .

* cited by examiner

*Primary Examiner*—Thomas Denion
*Assistant Examiner*—Tu M. Nguyen
(74) *Attorney, Agent, or Firm*—Kenyon & Kenyon

(57) ABSTRACT

An exhaust gas purifying apparatus of an internal combustion engine containing: an absorption-reduction catalyst which absorbs nitrogen oxides $NO_x$ included in exhaust when an air/fuel ratio of the exhaust is lean and reduces the absorbed $NO_x$ when the air/fuel ratio of the exhaust is a stoichiometric ratio or rich; and $NO_x$ amount estimating apparatus for estimating an amount of $NO_x$ absorbed in the $NO_x$ absorption-reduction catalyst; a rich spike executing apparatus for executing a rich spike while switching the air/fuel ratio to the stoichiometric ratio or to a rich air/fuel ratio when the amount of $NO_x$ estimated by the $NO_x$ amount estimating apparatus exceeds a permissible reference value; an atmospheric pressure detector for detecting atmospheric pressure; and an amount correcting apparatus for correcting the amount of $NO_x$ estimated by the $NO_x$ amount estimating apparatus, based on the atmospheric pressure detected by the atmospheric pressure detector, such that the amount of correction increases as atmospheric pressure decreases, whereby $NO_x$ absorbed in the $NO_x$ absorption-reduction catalyst can be reduced into harmless matter with accuracy and whereby deterioration of emissions can be restrained.

5 Claims, 6 Drawing Sheets

EXHAUST GAS PURIFYING APPARATUS OF INTERNAL COMBUSTION ENGINE

BACKGROUND OF THE INVENTION

1. Field of the Invention

The present invention relates to an exhaust gas purifying apparatus of an internal combustion engine for cleaning up noxious matter in exhaust gas emitted from the internal combustion engine.

2. Related Background Art

Examples of known emission cleaning apparatus having an $NO_x$ absorption-reduction catalyst include those as described in International Laying-open Publication WO93/25806. The $NO_x$ absorption-reduction catalyst is a catalyst that temporarily absorbs nitrogen oxides $NO_x$ included in the exhaust gas when the internal combustion engine burns fuel at an air/fuel ratio leaner than the stoichiometric ratio (the leaner ratio than the stoichiometric ratio being called a lean air/fuel ratio) and that reduces the absorbed $NO_x$ into harmless matter when the engine burns fuel at the stoichiometric ratio or at an air/fuel ratio richer than the stoichiometric ratio (the richer ratio than the stoichiometric ratio being called a rich air/fuel ratio). This $NO_x$ absorption-reduction catalyst also has the function of a three way catalyst to reduce the absorbed $NO_x$, using hydrocarbons HC and carbon monoxide CO included in the exhaust gas after combustion at the stoichiometric ratio or at a rich air/fuel ratio, as reductant. (On this occasion, HC and CO are oxidized.)

SUMMARY OF THE INVENTION

An object of the present invention is to provide an exhaust gas purifying apparatus of an internal combustion engine capable of maintaining the cleanness of exhaust gas by accurately reducing $NO_x$ absorbed in the $NO_x$ absorption-reduction catalyst.

The $NO_x$ absorption-reduction catalyst has a limit of $NO_x$-absorbing capacity. Therefore, the amount of $NO_x$ absorbed in the $NO_x$ absorption-reduction catalyst is estimated and a so-called "rich spike" is executed when the estimated amount of $NO_x$ exceeds a certain permissible reference value. The rich spike is an engine operation method for cleaning up $NO_x$, HC, and CO in the exhaust gas by actively turning the air/fuel ratio of the engine into a rich air/fuel ratio so as to reduce $NO_x$ absorbed in the $NO_x$ absorption-reduction catalyst with HC and CO in the exhaust gas while oxidizing HC and CO per se.

The amount of $NO_x$ absorbed in the $NO_x$ absorption-reduction catalyst is estimated based on an engine load and an engine speed. Then the reduction cleanup with the $NO_x$ absorption-reduction catalyst is carried out based on the estimated $NO_x$ amount. The inventors, however, found out the following fact; intake air flows vary with variations in the atmospheric pressure and such variations of intake air flows affect the engine load and engine speed, so as to fail in accurate reduction cleanup with the $NO_x$ absorption-reduction catalyst and deteriorate purifying performance.

Many exhaust gas recirculation systems for recirculating the emitted exhaust gas to an inlet system to reduce the $NO_x$ amount in the exhaust gas make use of the depression at engine manifold (intake vacuum). Therefore, in cases where the exhaust gas recirculation system is adopted, emitted $NO_x$ amounts also vary with variations in the intake vacuum due to the variations in the atmospheric pressure.

Namely, in the cases where the exhaust gas recirculation system is adopted, when the atmospheric pressure is lowered during a run on the highlands or the like, recirculation amounts of the exhaust gas by the exhaust gas recirculation system decrease, so that $NO_x$ amounts in the exhaust gas become greater than an estimated value. The inventors also found out the following; as a consequence of the deviation, the reduction cleanup with the $NO_x$ absorption-reduction catalyst is not effected accurately, and purifying performance could be deteriorated, particularly, where the exhaust gas recirculation system is adopted.

An exhaust gas purifying apparatus of an internal combustion engine according to the present invention comprises an $NO_x$ absorption-reduction catalyst placed in an exhaust path of the internal combustion engine, acting to absorb nitrogen oxides $NO_x$ included in exhaust when an air/fuel ratio of the exhaust flowing thereinto is lean, and acting to reduce the absorbed $NO_x$ when the air/fuel ratio of the exhaust flowing thereinto is a stoichiometric ratio or rich; $NO_x$ amount estimating means for estimating an amount of $NO_x$ absorbed in said $NO_x$ absorption-reduction catalyst, from an operating condition of said internal combustion engine; atmospheric pressure detecting means for detecting atmospheric pressure; and $NO_x$ amount correction means for correcting the amount of $NO_x$ estimated by said $NO_x$ amount estimating means, based on the atmospheric pressure detected by said atmospheric pressure detecting means.

Since the amount of $NO_x$ absorbed in the $NO_x$ absorption-reduction catalyst, which was estimated by the $NO_x$ amount estimating means, is corrected according to the atmospheric pressure detected by the atmospheric pressure detecting means, the present invention permits the amount of $NO_x$ absorbed in the $NO_x$ absorption-reduction catalyst to be estimated accurately, also taking increase/decrease of the $NO_x$ amount in the exhaust gas due to the influence of the atmospheric pressure into consideration. Therefore, the $NO_x$ absorbed in the $NO_x$ absorption-reduction catalyst can be reduced with accuracy to be cleaned up, based on the absorption amount of $NO_x$ estimated accurately, whereby the deterioration of purifying performance can be suppressed.

Another exhaust gas purifying apparatus of an internal combustion engine according to the present invention comprises an $NO_x$ absorption-reduction catalyst placed in an exhaust path of the internal combustion engine, acting to absorb nitrogen oxides $NO_x$ included in exhaust when an air/fuel ratio of the exhaust flowing thereinto is lean, and acting to reduce the absorbed $NO_x$ when the air/fuel ratio of the exhaust flowing thereinto is a stoichiometric ratio or rich; atmospheric pressure detecting means for detecting atmospheric pressure; rich spike executing means for executing a rich spike while switching the air/fuel ratio of the internal combustion engine to the stoichiometric ratio or a rich air/fuel ratio according to a rich spike execution condition defined in connection with an operating condition of the engine; and execution condition modifying means for modifying said rich spike execution condition according to the atmospheric pressure detected by said atmospheric pressure detecting means.

Since the $NO_x$ absorbed is cleaned up by the rich spike executing means while the rich spike execution condition is modified according to the atmospheric pressure detected by the atmospheric pressure detecting means, the present invention permits $NO_x$ in the exhaust gas to be cleaned up more efficiently and also permits the $NO_x$ absorbed in the $NO_x$ absorption-reduction catalyst to be reduced with accuracy, whereby the deterioration of purifying performance can be suppressed.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
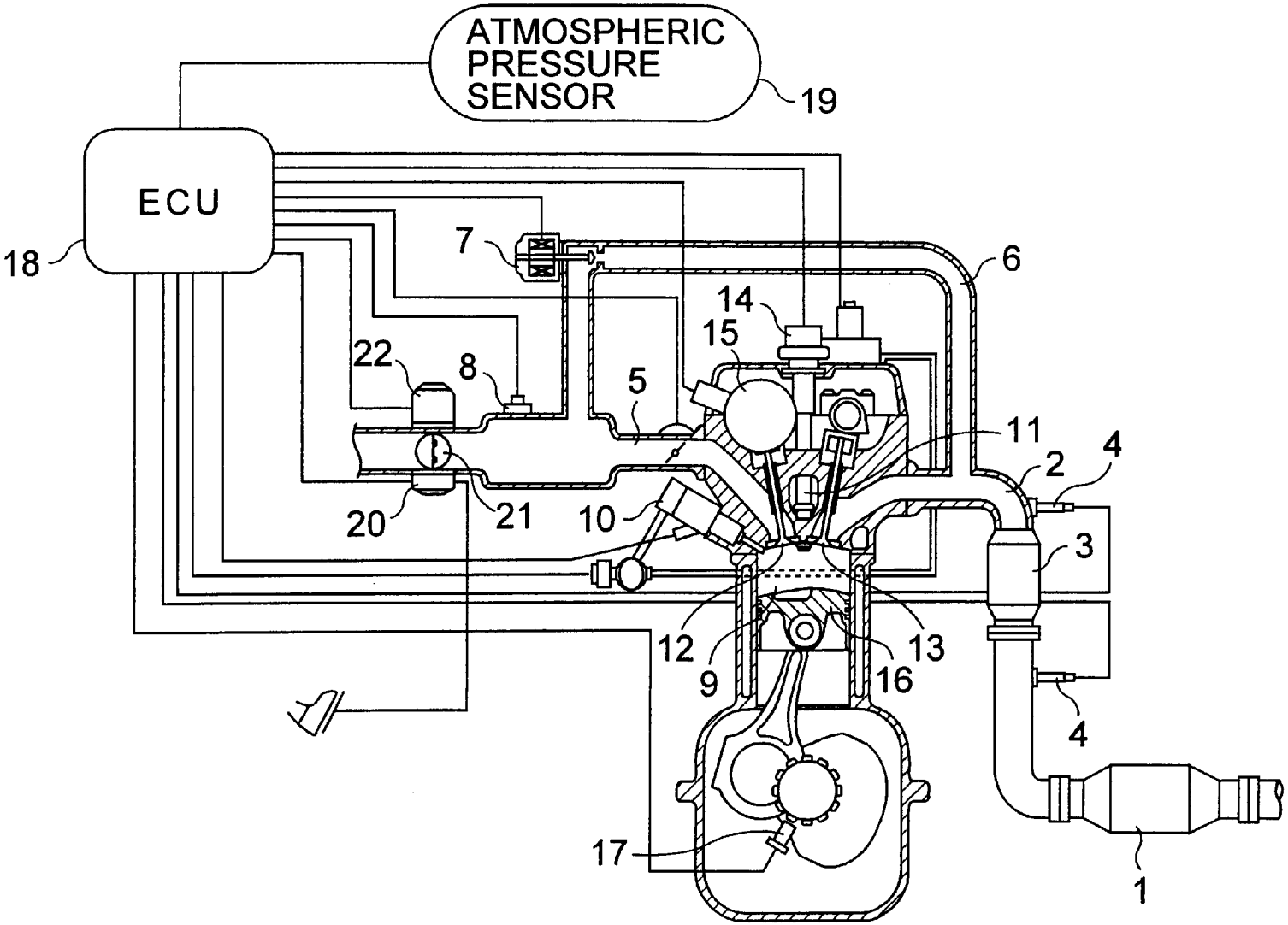
FIG. 1 is a sectional view to show the structure of an engine and a first embodiment of the exhaust gas purifying apparatus of the internal combustion engine according to the present invention.

The first embodiment of the exhaust gas purifying apparatus of the internal combustion engine according to the present invention will be described with reference to the drawings.

An exhaust gas purifying apparatus of the present embodiment has an $NO_x$ absorption-reduction catalyst 1. The $NO_x$ absorption-reduction catalyst 1 is placed on an exhaust path 2 of the engine which is an internal combustion engine. The $NO_x$ absorption-reduction catalyst 1 will be detailed hereinafter. A start catalyst 3, which is a normal three way catalyst, is also provided on the exhaust path 2 on the upstream side of the $NO_x$ absorption-reduction catalyst 1. Since the start catalyst 3 is set close to the combustion chamber of the engine, the temperature thereof is easy to increase with emission of exhaust gas; it is thus provided so as to be heated up to its catalytic activity temperature in an earlier stage after a start of the engine to clean up the noxious matter in the exhaust gas.

Two oxygen sensors 4, which are sensors to detect a concentration of oxygen in the exhaust gas, thereby detecting an air/fuel ratio of the engine, are mounted on the exhaust path 2. One is on the upstream side of the start catalyst 3. Another is on the downstream side of the start catalyst 3 and on the upstream side of the $NO_x$ absorption-reduction catalyst 1. For detecting the air/fuel ratio of the engine, various kinds of air/fuel ratio sensors can be substituted for the oxygen sensors. For example, a limiting current type oxygen sensor capable of linearly measuring the air/fuel ratio is usable. An exhaust gas recirculation path (which will be referred to hereinafter as an EGR path) 6 is formed between the exhaust path 2 and an intake path 5. Disposed on the EGR path 6 is an EGR valve 7 for opening/closing this path. Further, a pressure sensor 8 for detecting intake pressure is mounted on the intake path 5.

The engine equipped with the exhaust gas purifying apparatus has cylinders 9. This engine is a direct injection type engine, with which the fuel is directly injected into cylinders 9. An injector 10 is disposed in the upper part of each cylinder 9. The nozzle of the injector 10 is disposed in each cylinder 9. Also disposed in the upper part of each cylinder 9 is an ignition plug 11 to ignite a mixture gas in the cylinder 9, an intake valves 12 to make or cut off communication between intake path 5 and cylinder 9, and an exhaust valve 13 to make or cut off communication between exhaust path 2 and cylinder 9. An ignition coil 14 is connected to the ignition plugs 11.

The engine stated above is also provided with a variable valve timing mechanism 15 capable of continuously varying the opening/closing timing of the intake and exhaust valves 12, 13. The position of pistons 16 is monitored by crankshaft position sensor 17, and the ignition timing of the ignition plugs 11 and the opening/closing timing of the intake and exhaust valves 12, 13 are controlled in accordance with the position detected. The crankshaft position sensor 17 can also detect the engine speed, as well as the position of pistons 16.

The oxygen sensors 4, EGR valve 7, pressure sensor 8, injector 10, ignition coil 14, variable valve timing mechanism 15, and crankshaft position sensor 17 described above are connected to electronic control unit (ECU) 18. An atmospheric pressure sensor 19, which is an atmospheric pressure detecting means, is also connected to ECU 18. Also connected to ECU 18 are other various sensors such as an accelerator position sensor 20 for detecting a stroke of the accelerator pedal and the like and various devices such as a throttle motor 22 for driving a throttle valve 21 for control of inlet air flow and the like. The engine is systematically controlled by ECU 18. The ECU 18 is a microcomputer composed of CPU, ROM, RAM, etc. and is also equipped with a backup-RAM in which memory contents are retained by power from the battery without being erased even after the ignition key is turned off.

The ECU 18, together with the crankshaft position sensor 17 etc., also functions as an "$NO_x$ amount estimating means" for estimating an amount of $NO_x$ absorbed in the $NO_x$ absorption-reduction catalyst 1. The ECU 18 determines a final fuel injection amount by correcting a basic fuel injection amount determined based on the intake pressure and engine speed, for example, by feedback control of air/fuel ratio based on the detection result of oxygen sensors 4 or the like. In some cases the basic fuel injection amount is also determined based on the accelerator pedal stroke detected by the accelerator position sensor 20 and the engine speed detected by the crankshaft position sensor 17. The ECU 18 also functions as a "rich spike executing means" while working with the pressure sensor 8, the crankshaft position sensor 17, and so on.

Further, the ECU 18 can control the air/fuel ratio by controlling the fuel injection amount and thus also functions as an "execution condition modifying means" for modifying the rich spike condition by controlling the air/fuel ratio in the rich spike and the time of execution of the rich spike. In addition, the ECU 18 can variably control the "permissible reference value" (which will be detailed hereinafter) as a criterion for determining whether the rich spike is to be executed, working together with the various sensors and various devices, and thus also functions as an execution condition modifying means. Yet further, the ECU 18 can also correct the amount of $NO_x$ estimated by itself as an $NO_x$ amount estimating means and thus also functions as an "$NO_x$ amount correcting means".

By controlling the fuel injection amount injected from the injectors 10, for example, the engine described above can selectively carry out the combustion at a lean air/fuel ratio, at the stoichiometric ratio, or at a rich air/fuel ratio according to the operating condition. The above-stated engine can also perform the so-called stratified charge combustion by controlling the fuel injection amount, injection timing, valve opening/closing timing, etc. thanks to the shape of the upper surface of piston etc.

Now the $NO_x$ absorption-reduction catalyst 1 will be described.

The $NO_x$ absorption-reduction catalyst 1 is a catalyst obtained by preparing a carrier having the surface coated with a thin film of alumina and making the carrier carrying the noble metal such as platinum, palladium, rhodium, or the like and further carrying alkaline metal (potassium, sodium, lithium, cesium, etc.), alkaline earth metal (barium, calcium, etc.), or a rare earth element (lanthanum, yttrium, etc.) or the like, which is designed so as to be capable of absorbing $NO_x$ included in the exhaust gas when the engine is operated at lean air/fuel ratios.

Therefore, the $NO_x$ absorption-reduction catalyst 1 can absorb unreduced $NO_x$ included in the exhaust gas, in addition to the function of the normal three way catalyst, i.e., the function of cleaning up HC, CO, and $NO_x$ in the exhaust gas during combustion near the stoichiometric ratio. Since during the combustion at lean air/fuel ratios the exhaust gas includes little HC or CO to act as a reductant, $NO_x$ are unlikely to be reduced and the unreduced $NO_x$ are temporarily absorbed in the $NO_x$ absorption-reduction catalyst 1.

The $NO_x$ absorbed in the $NO_x$ absorption-reduction catalyst 1 are reduced into harmless matter by HC and CO in the exhaust gas during the combustion at rich air/fuel ratios (or near the stoichiometric ratio). (On this occasion HC and CO are oxidized at the same time.) Therefore, when it is determined that a certain amount of $NO_x$ are absorbed in the $NO_x$ absorption-reduction catalyst 1, the so-called rich spike operation is carried out to operate the engine at a rich air/fuel ratio for a short time to reduce the absorbed $NO_x$.

An estimated absorption amount of $NO_x$ absorbed in the $NO_x$ absorption-reduction catalyst 1 is calculated and stored by counting up or down a counter value in RAM in ECU 18. This $NO_x$ absorption amount is stored in the backup-RAM at every stop of the engine operation, and is read out when necessary.

The $NO_x$ counter value is counted up during the operation of the engine at lean air/fuel ratios, and the rich spike is carried out when the $NO_x$ counter value reaches the "permissible reference value". In the present embodiment this permissible reference value is a fixed value. While the engine is operated at the rich air/fuel ratios or at the stoichiometric ratio (for example, during acceleration or the like), $NO_x$ absorbed in the $NO_x$ absorption-reduction catalyst 1 are cleaned up, regardless of the rich spike operation; in this case, the $NO_x$ counter value is counted down.

Figure 2:
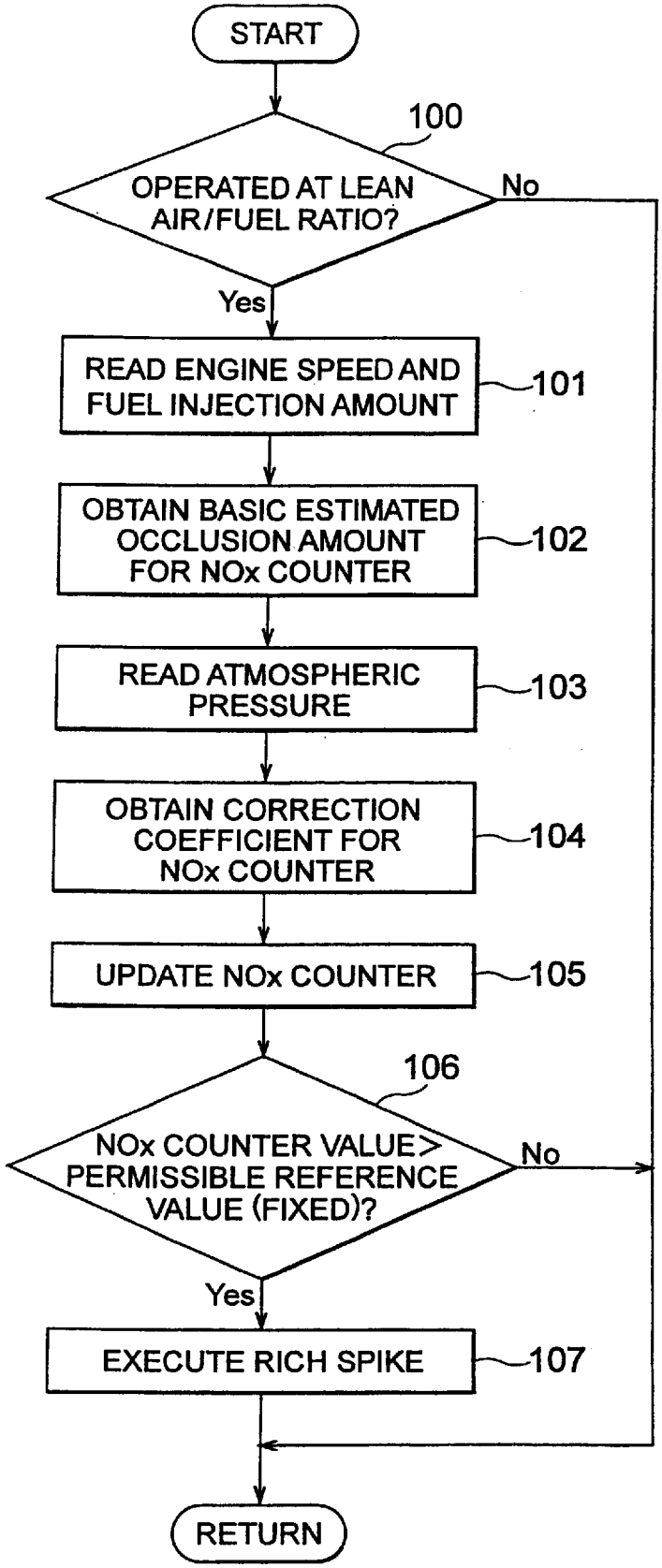
FIG. 2 is a flowchart to show an $NO_x$ absorption amount detecting routine in the first embodiment of the exhaust gas purifying apparatus of the internal combustion engine according to the present invention.

Now let us explain how to estimate the amount of $NO_x$ absorbed in the $NO_x$ absorption-reduction catalyst 1, based on the flowchart illustrated in FIG. 2. The flowchart illustrated in FIG. 2 is one carried out during the counting-up of the $NO_x$ counter. This flowchart is carried out repeatedly at intervals of a constant time (for example, every several milliseconds) during the operation of the engine.

The first step is to determine whether the engine is operated at a lean air/fuel ratio (step 100). This determination on whether the engine is operated at a lean air/fuel ratio can be made based on the output from the oxygen sensors 4 etc. or based on the inlet air flow calculated from the intake vacuum detected by the pressure sensor 8 and on the fuel injection amount injected from the injector 10 calculated by ECU 18. When the operation is not one at a lean air/fuel ratio, i.e., when step 100 is negated, this routine is terminated, because the $NO_x$ absorption-reduction catalyst 1 absorbs no $NO_x$ from the exhaust gas.

When the engine is operated at a lean air/fuel ratio, that is, when step 100 is affirmed, because the $NO_x$ absorption-reduction catalyst 1 absorbs $NO_x$, the engine speed and the fuel injection amount are read into the ECU 18 to estimate the amount of $NO_x$ (step 101). The engine speed is detected by the crankshaft position sensor 17. Since the fuel injection amount is calculated by the ECU 18 to dispatch an injection command to the injector 10, it is thus obtained from this calculated value.

Figure 3:
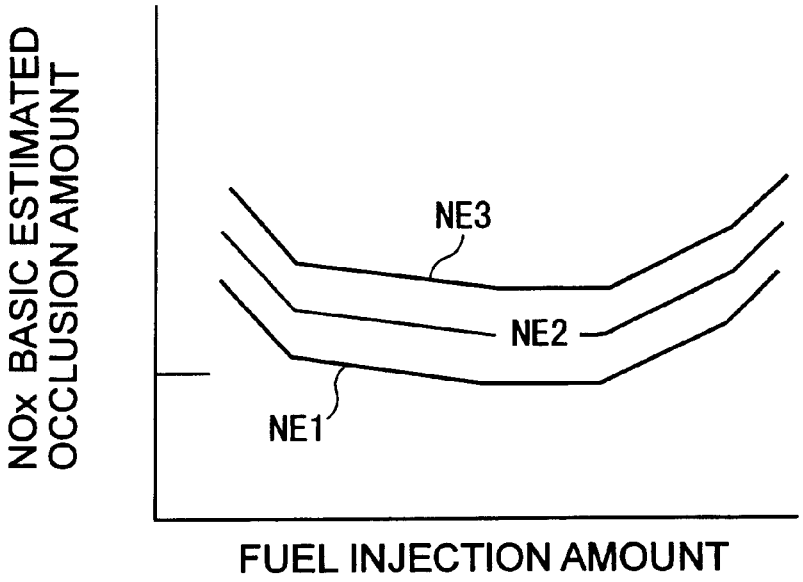
FIG. 3 is a schematic diagram of a map to show the relationship among fuel injection amount, engine speed, and basic estimated absorption amount of $NO_x$.

Based on the engine speed and fuel injection amount thus read, the "basic estimated absorption amount" for $NO_x$ counter described above is obtained from a pre-regulated map (step 102). Since there is such a tendency that the amount of $NO_x$ emitted increases with increasing engine speed and also increases with increasing fuel injection amount, the basic estimated absorption amount is determined from the engine speed and fuel injection amount. The map used in step 102 is illustrated in FIG. 3. Once the fuel injection amount (an abscissa in the map herein) and the engine speed (each broken line of NE 1 to NE 3 herein) are determined, the basic estimated absorption amount (an ordinate in the map herein) is determined. The basic estimated absorption amount can also be calculated or corrected, taking account of the inlet air flow, the intake pressure, the injection timing, the exhaust temperature, and the temperature of the catalyst, in addition to the engine speed and the fuel injection amount. The next step is to read the atmospheric pressure detected by the atmospheric pressure sensor 19 into the ECU 18 in order to correct the basic estimated absorption amount obtained in above step 102 in accordance with the atmospheric pressure (step 103).

Figure 4:
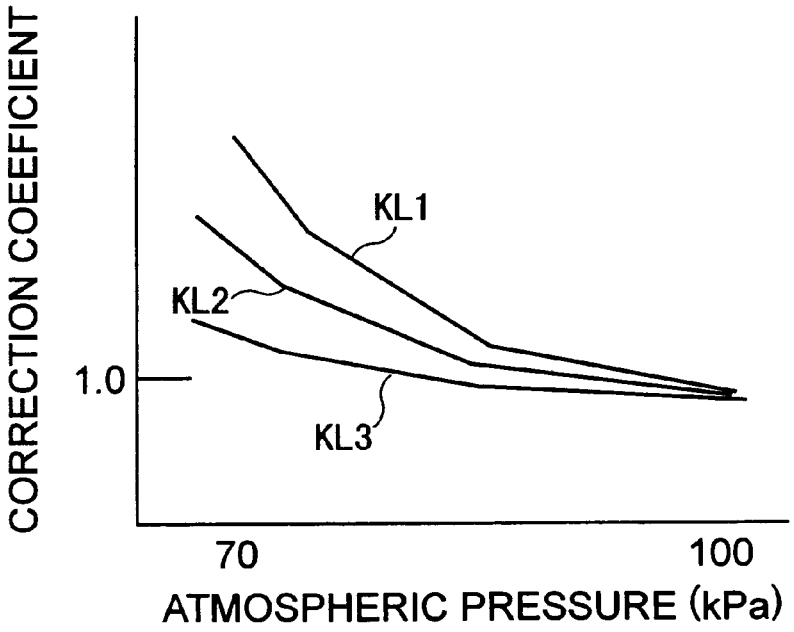
FIG. 4 is a schematic diagram of a map to show the relationship among atmospheric pressure, engine load, and correction coefficient for the estimated absorption amount of $NO_x$.

The next step is to search a map for a "correction coefficient" for correcting the aforementioned basic estimated absorption amount, based on the read atmospheric pressure (step 104). The map used herein is illustrated in FIG. 4. Once the atmospheric pressure (an abscissa in the map herein) is determined, the correction coefficient (an ordinate of the map herein) is determined. The present embodiment also employs the engine load (each broken line of KL 1 to KL 3 herein) as a further parameter. The engine load can be determined from the basic fuel injection amount, the intake vacuum detected by the pressure sensor 8, and so on.

The next step is to multiply the basic estimated absorption amount obtained in step 102 by the correction coefficient obtained in step 104 to calculate a counter value (step 105). The $NO_x$ counter is corrected and updated. In the present embodiment the correction coefficient was obtained as a value to be multiplied by the basic estimated absorption amount, but it may also be obtained as a value to be added thereto or subtracted therefrom. The next step is to determine whether the newly obtained $NO_x$ counter value is greater than the permissible reference value (the fixed value in the present embodiment) (step 106).

When in step 106 the newly obtained $NO_x$ counter value is not more than the permissible reference value, this routine is terminated, on the presumption that there still remains room to absorb $NO_x$ in the $NO_x$ absorption-reduction catalyst 1. On the other hand, when the newly obtained $NO_x$ counter value is greater than the permissible reference value, the rich spike is carried out (step 107) to clean up $NO_x$ absorbed in the $NO_x$ absorption-reduction catalyst 1. With execution of the rich spike, the $NO_x$ counter is reset (or the $NO_x$ counter is decreased with a lapse of time of the rich spike).

In the present embodiment, the permissible reference value is determined preliminarily and this permissible reference value is set to approximately a half of the $NO_x$ absorption limit of the $NO_x$ absorption-reduction catalyst 1. The permissible reference value is set to approximately a half of the absorption limit with consideration to cases in which the operating condition of the engine cannot allow execution of the rich spike even if the $NO_x$ counter value is greater than the permissible reference value, and with consideration to variations of the absorption limit due to individual differences among the $NO_x$ absorption-reduction catalysts and secular change thereof.

During the execution of the rich spike, the rich spike condition is modified in various ways, depending upon the atmospheric pressure. In this case, the air/fuel ratio during the rich spike and the period of executing time of the rich spike are controlled. When the rich spike condition is modified in this way, $NO_x$ in the exhaust gas can be cleaned up more efficiently. In another configuration, the apparatus may also be constructed so as to control the air/fuel ratio during the rich spike and the number of executions of the rich spike per unit time (rich spike cycles). In this case $NO_x$ in the exhaust gas can also be cleaned up more efficiently by modifying the rich spike condition in this way.

As described above, the rich spike is carried out by the rich spike executing means when the $NO_x$ amount corrected by the $NO_x$ amount correcting means after estimated by the $NO_x$ amount estimating means exceeds the permissible reference value. On this occasion, the execution condition modifying means modifies the rich spike execution condition according to the atmospheric pressure detected by the atmospheric pressure detecting means, whereby $NO_x$ in the exhaust gas can be cleaned up more efficiently. It also becomes possible to control execution frequency of rich spike.

In this case, the execution condition modifying means variably controls the period of executing time of rich spike, whereby the $NO_x$ amount capable of being cleaned up can be altered according to a state of atmospheric pressure. As a consequence, $NO_x$ in the exhaust gas can be cleaned up more efficiently. Particularly, when the permissible reference value is also controlled variably, the $NO_x$ absorption amount also varies therewith; therefore, the $NO_x$ absorption-reduction catalyst absorbing $NO_x$ can be cleaned with certainty by variably controlling the period of executing time of rich spike according to the varying $NO_x$ absorption amount.

Further, the execution condition modifying means also controls the air/fuel ratio during the rich spike in this embodiment, whereby the apparatus can change amounts of HC and CO in the exhaust gas, acting as reductants, during the cleaning of the $NO_x$ absorption-reduction catalyst, according to the state of atmospheric pressure. As a consequence, $NO_x$ in the exhaust gas can be cleaned up more efficiently. Particularly, when the permissible reference value is also controlled variably, the $NO_x$ absorption amount varies therewith, and the $NO_x$ absorption-reduction catalyst absorbing $NO_x$ can be cleaned with certainty by controlling the air/fuel ratio during the rich spike according to the varying $NO_x$ absorption amount so as to optimize the amounts of HC and CO necessary for the cleaning of the $NO_x$ absorption-reduction catalyst.

Next, the second embodiment will be described of the exhaust gas purifying apparatus of the internal combustion engine according to the present invention.

Since the structure of the exhaust gas purifying apparatus of the present embodiment is the same as that illustrated in FIG. 1 of the first embodiment described above, the description thereof is omitted herein. The present embodiment is different only in variable control of the permissible reference value from the exhaust gas purifying apparatus of the first embodiment described above.

Figure 5:
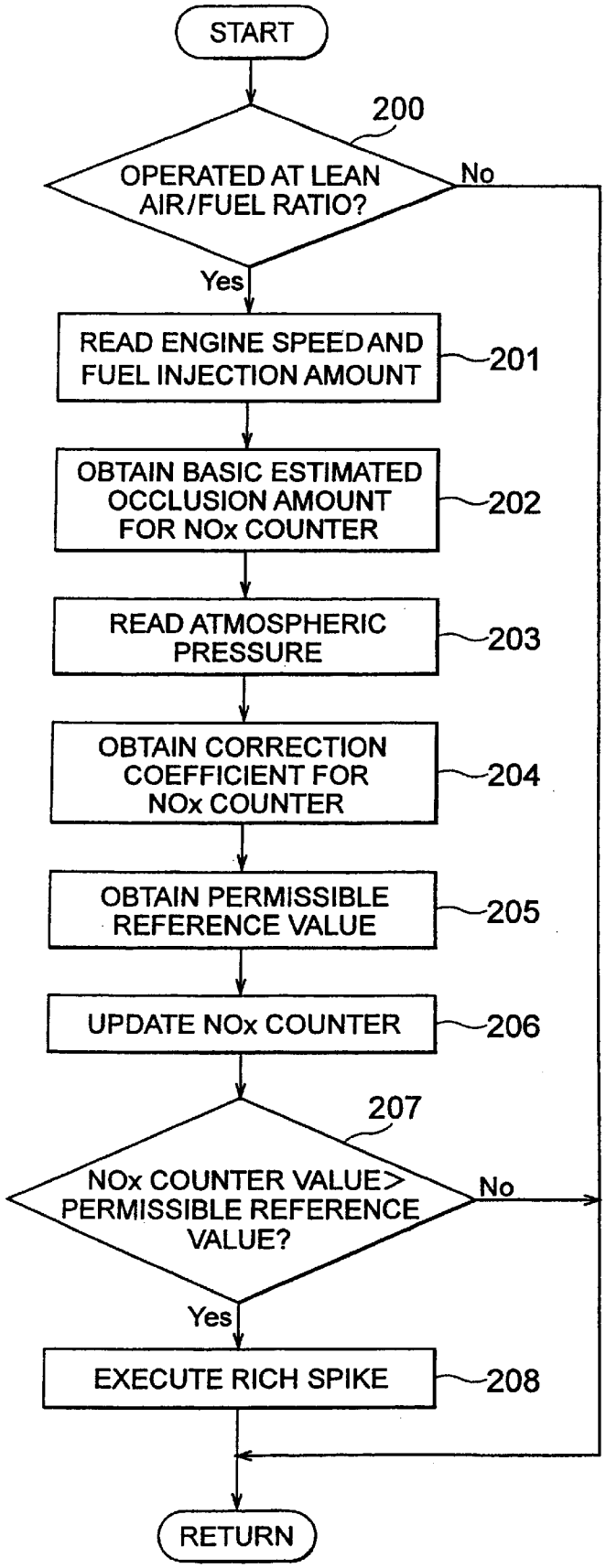
FIG. 5 is a flowchart to show the $NO_x$ absorption amount detecting routine in the second embodiment of the exhaust gas purifying apparatus of the internal combustion engine according to the present invention.

The estimation of amount of $NO_x$ absorbed in the $NO_x$ absorption-reduction catalyst 1 will be described below based on the flowchart illustrated in FIG. 5.

Since steps 200 to 204 are the same as steps 100 to 104 in the first embodiment described above, the description thereof is omitted herein.

Figure 6:
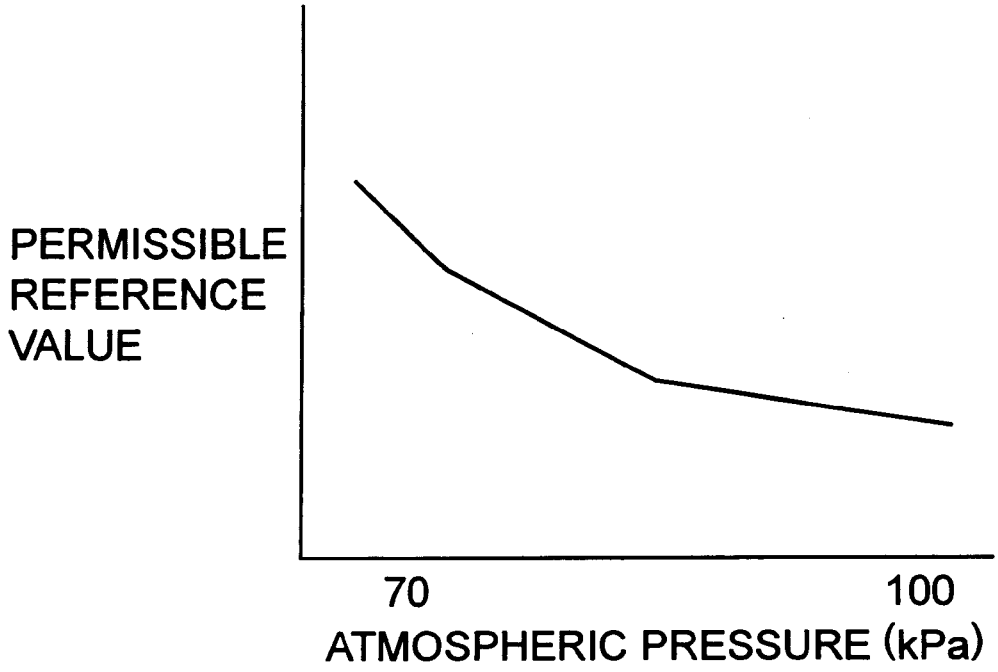
FIG. 6 is a schematic diagram of a map to show the relationship between atmospheric pressure and permissible reference value of the estimated absorption amount of $NO_x$.

Subsequent to step 204, the permissible reference value is searched for from the map, based on the atmospheric pressure read in step 203 (step 205). The map used herein is illustrated in FIG. 6. Once the atmospheric pressure (an abscissa in the map herein) is determined, the permissible reference value (an ordinate in the map herein) is determined. Since the absorption amount of $NO_x$ becomes large depending upon the atmospheric pressure, there are cases in which the rich spike is carried out frequently. There occurs a shock, though small, due to change in output torque of the engine at the time of the rich spike. If the permissible reference value is set to a rather large value, the rich spike does not have to be carried out so frequently, so that the occurrence of shock can be restrained. For example, the permissible reference value can be set as follows; the permissible reference value is normally set to approximately a half of the absorption limit of the $NO_x$ absorption-reduction catalyst 1, whereas, in cases in which the rich spike is carried out frequently depending upon the state of atmospheric pressure, the permissible reference value is increased to approximately 70% of the absorption limit of the $NO_x$ absorption-reduction catalyst 1.

Step 206 is the same as step 105 in the first embodiment. Subsequent to step 206, it is determined whether the $NO_x$ counter value newly obtained is greater than the permissible reference value calculated in step 205 (step 207). When in step 207 the newly obtained $NO_x$ counter value is not more than the permissible reference value, this routine is terminated, based on the presumption that there still remains room to absorb $NO_x$ in the $NO_x$ absorption-reduction catalyst 1. On the other hand, when the newly obtained $NO_x$ counter value is greater than the permissible reference value, the rich spike is carried out (step 208) to clean up $NO_x$ absorbed in the $NO_x$ absorption-reduction catalyst 1. When the rich spike is carried out, the $NO_x$ counter is reset.

The rich spike condition is modified in various ways according to the atmospheric pressure on the occasion of execution of the rich spike, as in the first embodiment. The apparatus of the present embodiment is arranged to control the air/fuel ratio during the rich spike and the period of executing time of rich spike (or the apparatus may also be arranged to control the air/fuel ratio during the rich spike and the rich spike cycle). Since the apparatus of this embodiment is arranged to variably control the permissible reference value, which is a criterion for determining whether the rich spike is to be carried out, as a further execution condition of rich spike, as described above, $NO_x$ in the exhaust gas can be cleaned up more efficiently.

Since in the present embodiment the execution condition modifying means controls the permissible reference value variably, the $NO_x$ absorption amount can be altered according to the state of atmospheric pressure. For this reason, $NO_x$ in the exhaust gas can be cleaned up more efficiently. For example, when the atmospheric pressure state is one in which $NO_x$ are increased in the exhaust gas, the permissible reference value is set to be larger than normal, so as to limit the number of rich spikes, whereby the $NO_x$ absorption-reduction catalyst absorbing $NO_x$ can be cleaned with certainty once the rich spike is carried out.

Next, the third embodiment will be described of the exhaust gas purifying apparatus of the internal combustion engine according to the present invention.

Since the structure of the exhaust gas purifying apparatus of the present embodiment is the same as that illustrated in FIG. 1 of the first embodiment described above, the description thereof is omitted herein. The present embodiment is different in the way of calculating the correction coefficient, from the exhaust gas purifying apparatus of the first embodiment described above. In the present embodiment, the basic estimated absorption amount is corrected for, not only according to the atmospheric pressure, but also according to a recirculation amount of exhaust gas recirculated by the EGR mechanism.

First, the EGR mechanism will be described briefly.

The EGR mechanism is intended mainly for decreasing the burning temperature by recirculation of exhaust gas to the intake system, so as to reduce the amount of $NO_x$ evolved. For recirculation of the exhaust gas, the present embodiment makes use of the negative pressure appearing in the intake path 5, i.e., the intake vacuum. The EGR path 6 is opened or closed by use of the EGR valve 7 which is opened or closed by electronic control. When the EGR valve 7 is opened, the exhaust gas in the exhaust path 2 is recirculated via the EGR path 6 to the intake path 5 because of the intake vacuum. This way of recirculation of the exhaust gas with the EGR path 6 is called an external EGR method.

On the other hand, there is another method called an internal EGR method for recirculating the exhaust gas into the cylinder 9 or to the intake path 5 by controlling the opening/closing timing of the intake and exhaust valves 12, 13. This method is a way in which the intake valve 12 is also opened temporarily during emission of exhaust gas with the exhaust valve 13 being opened after combustion, thereby recirculating the exhaust gas into the cylinder 9 or to the intake path 5 by the intake vacuum. The opening/closing timing of the intake and exhaust valves 12, 13 is controlled by the variable valve timing mechanism 15. As described, the exhaust gas is recirculated by making use of the intake vacuum both in the external EGR method and in the internal EGR method.

With change in the recirculation amount of exhaust gas, the volume of air newly taken in also varies, and the burning temperature also varies; therefore, there also appears variation in the amount of $NO_x$ emitted, i.e., in the amount of $NO_x$ absorbed in the $NO_x$ absorption-reduction catalyst 1. The EGR mechanism makes use of the intake vacuum and this intake vacuum is affected by the atmospheric pressure. Therefore, change in the atmospheric pressure results in change in the recirculation amount of exhaust gas by the EGR mechanism.

When the atmospheric pressure is low, for example, as in the case of a run on the highlands, the amount of exhaust gas recirculated decreases. As a result, where the EGR mechanism is adopted, the amount of $NO_x$ emitted (i.e., the amount of $NO_x$ absorbed in the $NO_x$ absorption-reduction catalyst 1) increases during the run on the highlands. Taking such cases into consideration, the present embodiment is adapted to correct the basic estimated absorption amount according to the recirculation amount of exhaust gas by the EGR mechanism, as well as according to the atmospheric pressure.

Figure 7:
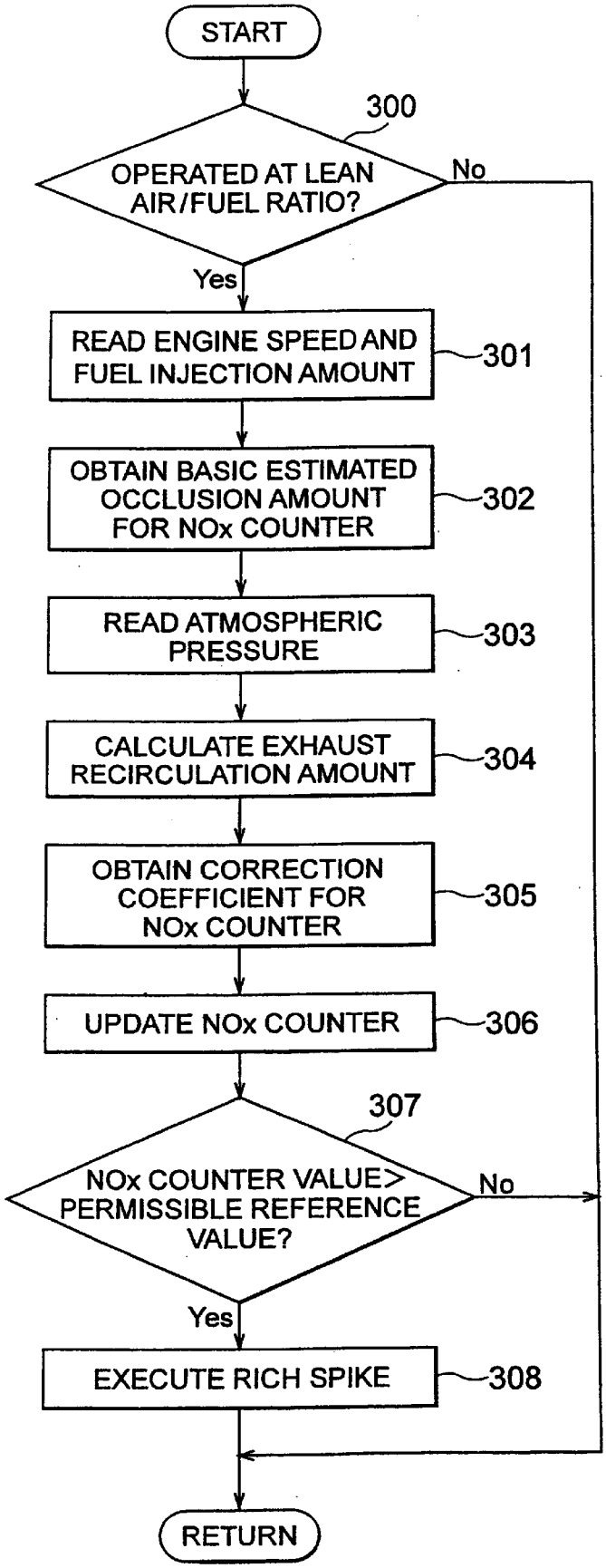
FIG. 7 is a flowchart to show the $NO_x$ absorption amount detecting routine in the third embodiment of the exhaust gas purifying apparatus of the internal combustion engine according to the present invention.

The estimation of amount of $NO_x$ absorbed in the $NO_x$ absorption-reduction catalyst 1 will be described below based on the flowchart illustrated in FIG. 7.

Since steps 300 to 303 are the same as steps 100 to 103 in the first embodiment described above, the description thereof is omitted herein.

Subsequent to step 303, the recirculation amount of exhaust gas is calculated (step 304). The recirculation amount of exhaust gas can be calculated from the intake vacuum detected by the pressure sensor 8 and a valve opening and an open time of the EGR valve 7. As to the external EGR, it can also be calculated by setting a flow meter on the EGR path 6 and using output of this flow meter. In the case of the internal EGR, the recirculation amount of exhaust gas can also be calculated from the intake vacuum detected by the pressure sensor 8 and an open overlap time of the intake and exhaust valves 12, 13.

Then the correction coefficient is calculated based on the atmospheric pressure read in step 303 and the recirculation amount of exhaust gas calculated in step 304 (step 305). At this time, the apparatus may be arranged to calculate one correction coefficient from the atmospheric pressure and the recirculation amount or may also be arranged to calculate one correction coefficient from the atmospheric pressure and another correction coefficient from the recirculation amount.

The basic estimated absorption amount calculated in step 302 is corrected by using the correction coefficient thus calculated, and then the $NO_x$ counter is updated (step 306). Since step 307 and step 308 are the same as step 106 and step 107 in the first embodiment described above, the description thereof is omitted herein. Although in the present embodiment the permissible reference value is fixed, the permissible reference value may also be subject to variable control according to the atmospheric pressure (or according to the atmospheric pressure and the recirculation amount of exhaust gas) as in the second embodiment described above.

When the EGR mechanism is also used in combination to effect correction for the $NO_x$ absorption amount according to the recirculation amount of exhaust gas as well as according to the atmospheric pressure as described above, the amount of $NO_x$ absorbed in the $NO_x$ absorption-reduction catalyst can be estimated more accurately and the $NO_x$ absorption-reduction catalyst absorbing $NO_x$ in the exhaust gas can be cleaned with certainty.

As described above, the present embodiment is constructed so that the $NO_x$ amount correcting means corrects the $NO_x$ amount estimated by the $NO_x$ amount estimating means, based on the atmospheric pressure detected by the atmospheric pressure detecting means and the recirculation amount of exhaust gas recirculated by the exhaust gas recirculating means. Because of this arrangement, the amount of $NO_x$ itself in the exhaust gas is reduced by the use of the exhaust gas recirculating means, in addition to the cleaning effect by the $NO_x$ absorption-reduction catalyst, so that the atmosphere can be prevented from being polluted by $NO_x$. Further, the amount of $NO_x$ absorbed in the $NO_x$ absorption-reduction catalyst can be estimated accurately, taking account of not only the increase or decrease of the $NO_x$ amount in the exhaust gas due to the influence of the atmospheric pressure, but also the increase or decrease of the $NO_x$ amount in the exhaust gas due to the recirculation amount of exhaust gas by the exhaust gas recirculating means. As a result, the $NO_x$ absorption-reduction catalyst absorbing $NO_x$ in exhaust gas can be cleaned with certainty, based on the $NO_x$ absorption amount estimated accurately.

Particularly, where the exhaust gas recirculating means makes use of the intake vacuum, the intake vacuum is affected by the atmospheric pressure, so that the variations in the atmospheric pressure affect the recirculation amount of exhaust gas. Therefore, the amount of $NO_x$ absorbed in the $NO_x$ absorption-reduction catalyst can be estimated more accurately by taking both the atmospheric pressure and the recirculation amount of exhaust gas into consideration.

It is noted that the exhaust gas purifying apparatus of the internal combustion engine according to the present invention is not limited to the embodiments described above. For example, the embodiments described above were arranged to correct the $NO_x$ absorption amount according to the atmospheric pressure detected, but the exhaust gas purifying apparatus of the internal combustion engine may also be arranged to modify the rich spike execution condition simply according to the atmospheric pressure without estimating the $NO_x$ amount. For example, cycles for execution of rich spike operation are preliminarily set up through experiments, the exhaust cleaning catalyst is subjected to the rich spike operation based on the execution cycles, and the execution cycles are corrected according to the atmospheric pressure detected. In this way the deterioration of emissions can also be restrained by reducing $NO_x$ absorbed in the $NO_x$ absorption-reduction catalyst accurately, even without estimating the amount of $NO_x$ absorbed. The execution cycles described above may be replaced by time of continuation of a low state of "engine load," "intake air flow," or "fuel injection amount" during lean operation.

The above-described embodiments were designed to estimate the basic estimated absorption amount of $NO_x$ absorbed in the $NO_x$ absorption-reduction catalyst 1 from the engine speed and the fuel injection amount, but the apparatus may also designed to estimate the basic estimated absorption amount from another detected amount. For example, it may also be estimated using the intake vacuum detected by the pressure sensor 8.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An exhaust gas purifying apparatus of an internal combustion engine comprising:

an $NO_x$ absorption-reduction catalyst placed in an exhaust gas path of the internal combustion engine, acting to absorb nitrogen oxides $NO_x$ included in exhaust when an air/fuel ratio of the exhaust flowing thereinto is lean, and acting to reduce the absorbed $NO_x$ when the air/fuel ratio of the exhaust flowing thereinto is a stoichiometric ratio or rich;

$NO_x$ amount estimating means for estimating an amount of $NO_x$ absorbed in said $NO_x$ absorption-reduction catalyst, from an operating condition of said internal combustion engine;

atmospheric pressure detecting means for detecting atmospheric pressure;

exhaust gas recirculating means for recirculating exhaust gas to an intake system of said internal combustion engine; and $NO_x$ amount correcting means for correcting the amount of $NO_x$ estimated by said $NO_x$ amount estimating means, based on the atmospheric pressure detected by said atmospheric pressure detecting means, wherein said $NO_x$ amount correcting means corrects the amount of $NO_x$ estimated by said $NO_x$ amount estimating means, based on the atmospheric pressure detected by said atmospheric pressure detecting means and on a recirculation amount of the exhaust gas recirculated by said exhaust gas recirculating means, and further wherein the amount of $NO_x$ is corrected larger when the detected atmospheric pressure is lower.

2. The exhaust gas purifying apparatus of the internal combustion engine according to claim 1, further comprising rich spike executing means for executing a rich spike while switching the air/fuel ratio of the internal combustion engine to the stoichiometric ratio or to a rich air/fuel ratio when the amount of $NO_x$ corrected by said $NO_x$ correcting means after estimated by said $NO_x$ amount estimating means exceeds a permissible reference value; and execution condition modifying means for modifying an execution condition of said rich spike according to the atmospheric pressure detected by said atmospheric pressure detecting means.

3. The exhaust gas purifying apparatus of the internal combustion engine according to claim 2, wherein said execution condition modifying means performs variable control of said permissible reference value.

4. The exhaust gas purifying apparatus of the internal combustion engine according to claim 2, wherein said execution condition modifying means performs variable control of a period of executing time of said rich spike.

5. The exhaust gas purifying apparatus of the internal combustion engine according to claim 2, wherein said execution condition modifying means controls the air/fuel ratio during said rich spike.

* * * * *